US005163308A

United States Patent [19]

Lillo

[11] Patent Number: 5,163,308

[45] Date of Patent: Nov. 17, 1992

[54] SECURING DEVICE COMPRISING PADLOCK AND ANCHORED CRADLE HOUSING

[76] Inventor: Gerald D. Lillo, 4572 Willard West Rd., Willard, Ohio 44890

[21] Appl. No.: 917,578

[22] Filed: Jul. 21, 1992

[51] Int. Cl.[5] ..... E05B 67/38

[52] U.S. Cl. ..... 70/51; 70/56; 70/100; 70/DIG. 57

[58] Field of Search ..... 70/51-56, 70/39, 95, 100, 120, DIG. 57

[56] References Cited

U.S. PATENT DOCUMENTS 2,959,951 11/1960 Mirkin ..... 70/53
4,095,828 6/1978 East ..... 292/148
4,106,315 8/1978 Dohanyos ..... 70/56
4,300,370 11/1981 Kaiser et al. ..... 70/54
4,576,022 3/1986 Gamble ..... 70/55
4,583,381 4/1986 Sjogren ..... 70/95
4,788,836 12/1988 Poe ..... 70/2
4,920,772 5/1990 Denison ..... 70/56 X

*Primary Examiner*—Lloyd A. Gall

[57] ABSTRACT

A device for locking doors and other objects to prevent unauthorized use or entry comprising a conventional padlock embraced by a metal cradle housing, the rear panel apertured to provide a fastening means to hold the cradle housing to a door or other object. The top and bottom of the cradle housing being apertured to receive the shackle legs of the padlock. The ends of the shackle legs, acting as dead bolts, are aligned so as to enter the apertures of the lock plate which is anchored to a stationary object such as a door frame or floor.

1 Claim, 1 Drawing Sheet

SECURING DEVICE COMPRISING PADLOCK AND ANCHORED CRADLE HOUSING

BACKGROUND

1. Field of Invention

This invention relates to securing devices. Specifically, this invention relates to means for anchoring a conventional padlock to a door and utilizing the shackle legs as dead bolts.

2. Description of Prior Art

Conventional or known padlocks are well known in the art as is the conventional hasp.

In the prior art generally, means of securing a door by conventional padlock utilizes a locking apparatus containing a slotted hasp and staple combination.

Generally, the slotted hasp is monted to a door and the u-shaped staple mounted to the door frame or structure. When the door is closed the slotted hasp is placed over the staple and secured together by a padlock, whereby unauthorized entry is prevented.

Several inventors have created locking assemblies utilizing a conventional padlock/hasp combination and other similar securing devices.

U.S. Pat. No. 4,095,828 (1978) issued to East discloses a locking assembly which combines a padlock wherein the shackle of the padlock is housed within a rigid protective enclosure when the assembly is locked. Although an improvement over the conventional hasp-/padlock combination the padlock must extend considerably outward, horizontal to the door, which is clumsy and commercially unattractive in appearance.

U.S. Pat. No. 4,788,836 (1988) issued to Poe describes a tamper proof variation to the conventional hasp utilizing a conventional padlock. Although its tampering proof design is an improvement to the conventional hasp and somewhat more commercially desirable, its use is limited in that it can only be used when the object being secured has two flush or flat surfaces to which the hasp's plates can be attached.

Conventional hasp type locking devices certainly serve a purpose and are well known. However, the slotted strap and u-shaped staple is not an acceptable device for commercial use where the user requires security as well as appearance. They simply do not possess a neat and commercial like appearance.

OBJECTS AND ADVANTAGES

Several objects and advantages of the present invention are:

(a) to provide a securing device which utilizes a conventional padlock as an integrated component thereof;

(b) to provide securing device which is of simple design and easily manufactured;

(c) to provide a securing device which is simple to use and commercially superior to the conventional hasp/padlock combination.

DRAWING FIGURES

In the drawings, closely related figures have the same number but different alphabetic suffixes.

REFERENCE NUMERALS IN DRAWINGS

| | |
|---|---|
| 7. cradle housing | 8. padlock |
| 9. casing | 10. shackle |
| 11. lock plate | 12. rear panel |
| 14. top panel | 16. bottom panel |
| 18. front panel | 20. end panel |
| 22. aperture | 24. fasteners |
| 26. aperture | 28. aperture |
| 30. key | 32. aperture |
| 34. aperture | 36. aperture |
| 38. fastener | 40. aperture |

DESCRIPTION—FIGS. 1 TO 4

Figure 1:
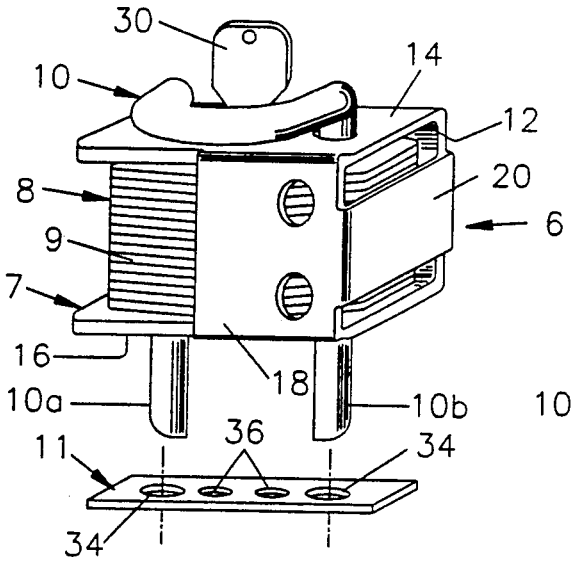
FIG. 1 shows a perspective view of the present invention.
Figure 3:
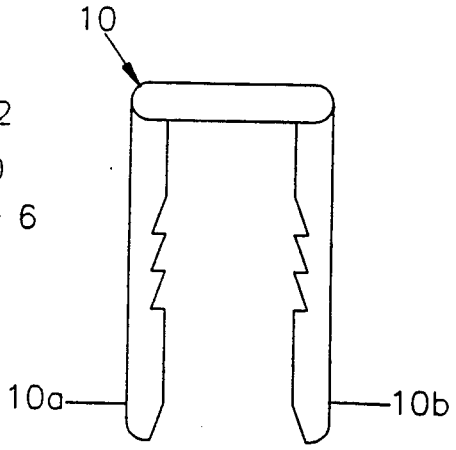
FIG. 3 shows a view of the shackle removed from the padlock.
Figure 4:
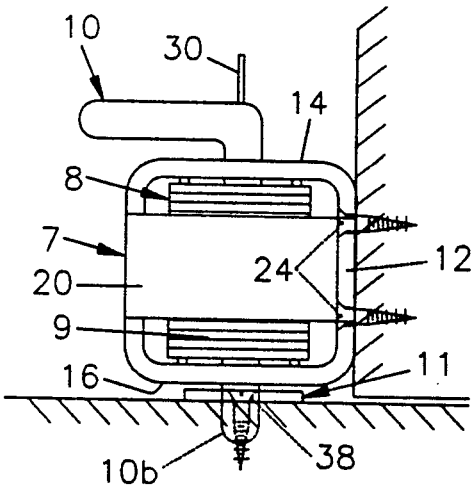
FIG. 4 shows a side view of the present invention.

Referring more specifically to the drawings, a securing device embodying the present invention is generally designated 6 in FIG. 1 and FIG. 4. It comprises a conventional padlock 8 having a casing 9 of generally rectangular solid shape with two cylindrical openings extending through it, which is used in combination with a shackle 10 (FIG. 3), with arms 10*a* and 10*b*, adapted to extend into said openings through casing 9.

Figure 2:
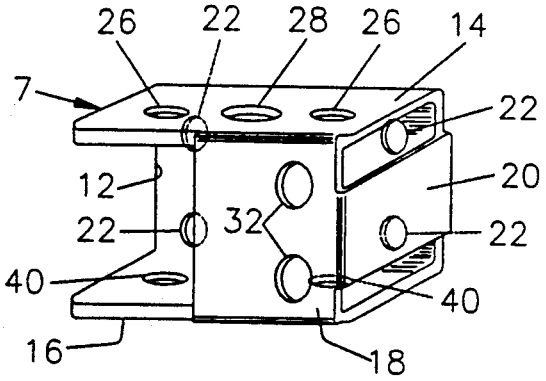
FIG. 2 shows a perspective view of the cradle housing without its associated padlock.

Embracing the padlock, as shown, is a metal cradle housing 7 (FIG. 2). The cradle housing 7 comprises a rear panel 12, a top panel 14, a bottom panel 16, a partial front panel 18, and an end panel 20.

As shown in FIG. 2, the rear panel 12 is apertured as at 22 to provide for passage of fasteners 24.

The top panel 14 (FIG. 2) is formed with two apertures as at 26 to receive the legs 10*a* and 10*b* of the shackle 10 and one larger aperture as at 28 to permit passage of a key 30 into the lock keyway (not shown).

The partial front panel 18 is formed with two apertures as at 32 to permit passage of a screwdriver to facilitate installing fasteners 24.

The bottom panel 16 (FIG. 2) is formed with two apertures as at 40 to receive the legs 10*a* and 10*b* of the shackle 10 after passing through the casing 9.

The metal lock plate 11 (FIG. 1) is formed with two apertures as at 34 to receive the legs 10*a* and 10*b* of the shackle 10 and two additional apertures as at 36 to permit passage of fasteners 38.

From the description above, a number of advantages of my securing device become evident:

(a) It is a compact device of simple design which can be used to secure a variety of objects including, but not limited to, single doors, double doors, garage doors, sliding doors and windows.

(b) Installation of the device is simple and flexible in that it can be mounted vertically or horizontally and can be used inside or outside.

(c) The device is an effective security device which is attractive in appearance and therefore more desirable in commercial use than the conventional hasp-/lock combination.

OPERATION—FIGS. 1, 2, 3, 4

The manner of using the securing device to lock an object is different from devices in present use in that my invention utilizes the legs 10*a* and 10*b* of the shackle 10 as a dead bolt type locking device.

The securing device can be mounted vertically or horizontally. As shown in FIG. 4 in use the metal cradle housing 7 is anchored to an object such as a door by headed fasteners such as 24 and the metal lock plate 11 is anchored to a stationary object such as a wall, or floor, by headed fasteners such as 38. When it is desired to secure the object in order to prevent its use or unauthorized entry a padlock 8, with its shackle 10 removed, is inserted into the metal cradle housing 7 by sliding the casing 9 laterally into the cradle housing. The legs 10*a* and 10*b* of the shackle 10 are then inserted into the top panel 14 of the cradle housing through apertures 26 passing through casing 9, then through apertures 40 of the bottom panel 16 of the cradle housing and into the apertures 34 of the metal lock plate 11.

When it is desired to unlock the device, a key 30 is inserted through the cradle housing at aperture 28, into the keyway (not shown) of the padlock 8 and the key is turned, as is conventional. The shackle is then moved to release legs 10*a* and 10*b* from the lock plate 11. The padlock can then be removed from the cradle housing if desired.

SUMMARY, RAMIFICATIONS AND SCOPE

Accordingly, the reader will see that the securing device of this invention can be used to lock and secure an object easily and conveniently, can be mounted vertically or horizontally and can be used to secure a variety of objects. In addition, it is unique in that it utilizes the padlock's shackle legs as dead bolts.

The simple design makes it easy to manufacture and its appearance makes it commercially more attractive than the conventional hasp.

Although the description above contains many specificities, these should not be construed as limiting the scope of this invention but merely providing illustrations of some of the presently preferred embodiments of this invention. For example, the cradle housing can have a full front panel formed with an aperture to permit a key to be inserted into a padlock which have a keyway located on the front panel of the padlock instead of the top.

Thus the scope of the invention should be determined by the appended claims and their legal equivalents, rather than by the examples given.

I claim:

1. A securing device of the type comprising: (a) a conventional padlock having a casing of generally a rectangular solid shape with two cylindrical openings extending entirely through said casing to receive a shackle having parallel legs adapted to extend through openings provided therefor in said casing and a keyhole at the top of said casing: (b) a metal cradle housing comprising a back panel, top and bottom panels, a side panel and a partial front panel, the panels defining a pocket adapted to receive the casing of the padlock from a lateral direction, the top panel being apertured to receive the shackle legs and expose the keyhole, the bottom panel apertured to receive the shackle legs, and having the back panel apertured to permit passage of fasteners; (c) a metal lock plate apertured to receive the shackle legs and means to fasten the lock plate to a stationary member.

* * * * *